US005842525A

United States Patent [19]

Graham

[11] Patent Number: 5,842,525

[45] Date of Patent: Dec. 1, 1998

[54] BURNING PAN FIRE EXTINGUISHER

[76] Inventor: Robert Anthony Graham, 80 Rudgwick Drive, Brandlesholme, Bury, Lancashire, United Kingdom

[21] Appl. No.: 913,098

[22] PCT Filed: Mar. 7, 1996

[86] PCT No.: PCT/GB96/00519

§ 371 Date: Sep. 8, 1997

§ 102(e) Date: Sep. 8, 1997

[87] PCT Pub. No.: WO96/27410

PCT Pub. Date: Sep. 12, 1996

[30] Foreign Application Priority Data

Mar. 8, 1995 [GB] United Kingdom ..... 9504608

[51] Int. Cl.[6] ..... A62C 8/08

[52] U.S. Cl. ..... 169/50; 169/48; 169/49; 431/144

[58] Field of Search ..... 169/48, 49, 50; 431/144, 146, 147

[56] References Cited

U.S. PATENT DOCUMENTS 3,283,826 11/1966 Padellford .

4,602,611 7/1986 Hankey .

FOREIGN PATENT DOCUMENTS 795 757 3/1936 France .
423 261 2/1935 United Kingdom .
1 464 622 2/1977 United Kingdom .
WO A 81 01106 4/1981 WIPO .

*Primary Examiner*—Andres Kashnikow
*Assistant Examiner*—David Deal
*Attorney, Agent, or Firm*—Salter & Michaelson

[57] ABSTRACT

A hot oil/fat fire extinguisher, comprising a frame which supports a smothering material in a horizontal plane and a handle which allows the safe and effective application of the smothering material to a container of burning fat/oil. When not in use it may be stored in a holder which can be wall mounted. In the event of a container of fat/cooking oil igniting, the extinguisher can be removed from the holder by using the handle and presents a smothering material of a size and shape suitable for covering the container of burning fat/oil. This is placed over the container in the manner prescribed in the instructions of use, depriving the burning surface of air and achieving extinction.

11 Claims, 1 Drawing Sheet

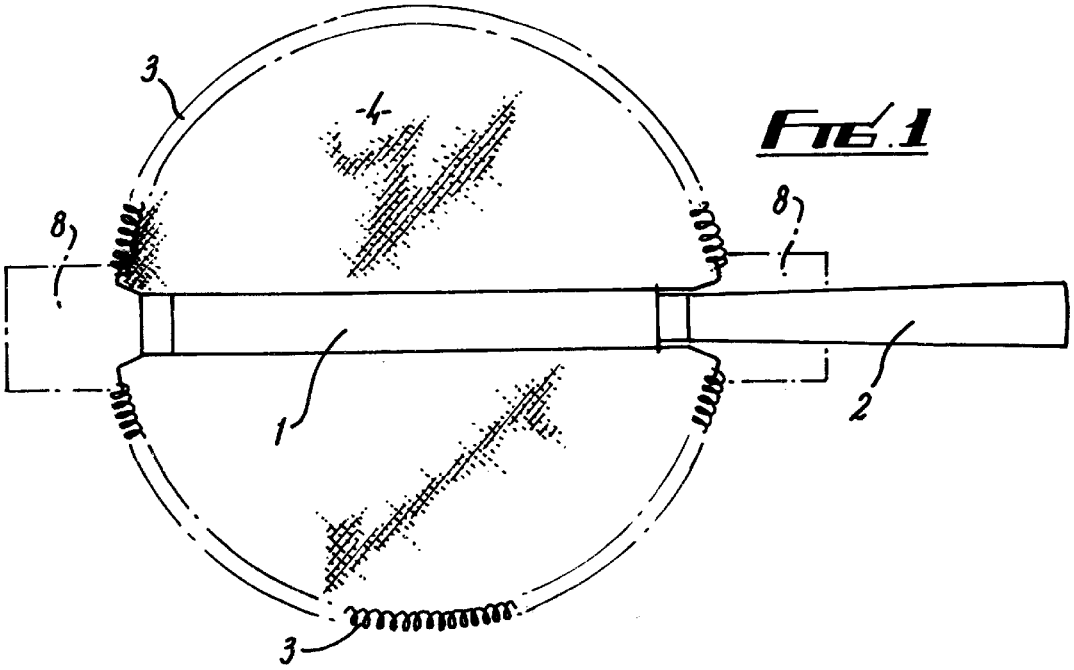
FIG. 1
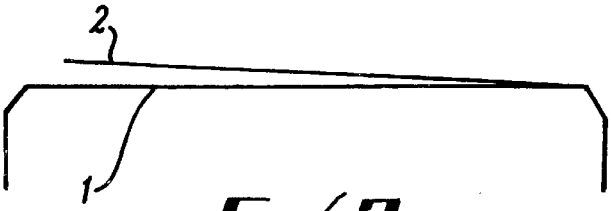
FIG. 2
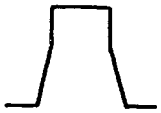
FIG. 3
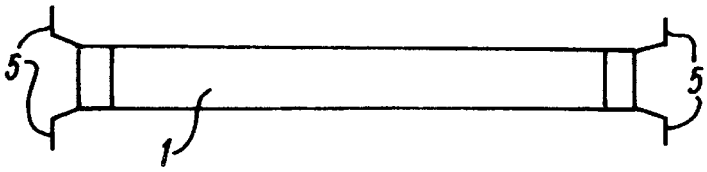
FIG. 4
FIG. 5
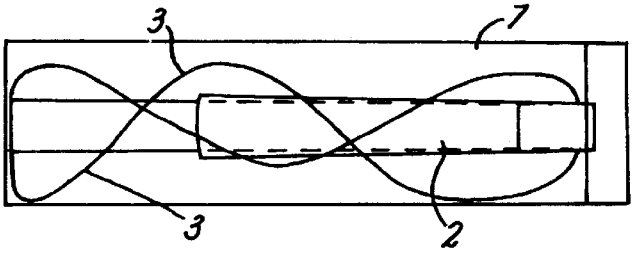
FIG. 6
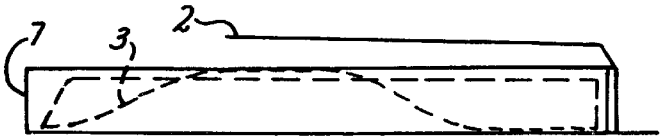

BURNING PAN FIRE EXTINGUISHER

This invention relates to a fire extinguisher particularly, but not exclusively, for use in extinguishing oil or fat fires.

Deep frying is a method of cooking which involves raising the temperature of cooking oil or fat to approximately 180°–190° C. If the temperature is allowed to rise for a further 5 to 10 minutes, the heated oil or fat can self ignite creating a serious fire hazard.

The accepted method of extinguishing fires involving cooking oil or fat in pans is to cover the pan with a fire blanket made of proprietary fabrics. This can be a very dangerous process as it involves bringing the hands holding the fire blanket over the top of the burning pan. There is also the risk of the pan being tipped over by the weight of the fire blanket, spilling the hot oil/fat. This method of extinguishing the fire demands a level of skill for it to be achieved safely and effectively without sustaining burn or scald injuries.

According to United Kingdom fire statistics nearly half of reported accidental dwelling fires each year are attributed to fires starting in cooking oil/fats. These fires are the cause of over 4,000 non-fatal casualties each year. The majority of these injuries are incurred while attempting to extinguish or control oil or fat fires.

According to the present invention there is provided an extinguisher for extinguishing pan fires, comprising a frame, a handle connected to the frame, resilient means connected to the frame and smothering material connected to the frame, the resilient means being movable between a stored position in which the extinguisher may be stored in a holder and an operative position in which the smothering material is automatically extended by the resilient means.

In a preferred embodiment, the handle and/or frame may be made from metal or synthetic plastics material. The handle and/or frame may be wire or stamped or pressed out or moulded. The handle and/or frame may be formed to provide positioning means. The resilient means may be a spring preferably a helical spring. The handle and frame may be pivotally connected to enable the handle to be folded with respect to the frame. The smothering material may be connected to the resilient means by stitching.

A specific embodiment of the invention will now be described by way of example with reference to the accompanying drawing in which:

FIG. 1 shows the extinguisher ready for use in a plan view,

FIG. 2 shows a side elevational view of part of the extinguisher of FIG. 1, FIG. 3 shows an end elevational view of the part shown in FIG. 1, FIG. 4 shows a plan view of the part shown in FIG. 1, FIG. 5 shows a plan view in section of the extinguisher housed in a holder, and FIG. 6 shows a side elevational view of the extinguisher of FIG. 5.

Referring to the drawing, the fire extinguisher comprises a frame 1, handle 2, folding arm 3 and smothering material 4.

The frame 1 and handle 2 can be made of wire forms, metal pressings, stampings of forms and mouldings of other natural or man-made suitable materials or combinations of these. The handle may be made to fold for compact storage. The handle 2 may be pivoted with respect to the frame 1 through 180°, between a first position in which the handle 2 overlies the frame 1 and a second position in which the handle 2 extends substantially in line with the handle 2. In cross section (see FIG. 3), the frame has an inverted U-shape at opposite ends thereof to accommodate a pan handle on which the extinguisher is to be used. These ends also provide a positioning lip to facilitate the positioning of the extinguisher on the pan.

The folding arms 3 are resilient. In this example they comprise helical springs which are attached to the frame 1. For this purpose the frame 1 has extensions 5 which are inserted into the open ends of the adjacent helical springs. The smothering material 4 is attached to the folding arms by stitching or by rivets or other means which are resistant to heat and flames.

The resilient folding arms of the frame can alternatively be made of flat springs or pre-formed metal or high performance man made or natural materials or combinations of these, which must retain tension for the designed life of the device. They may be straight, curved or jointed.

The smothering material 4 is flexible and meets the requirements of the British Standard Specification for fire blankets when tested in accordance with BS 6575:1985, light duty fire blankets, and any future revisions thereto, as a minimum. The material 4 is substantially circular in shape, but has additional flaps 8 adjacent opposite ends of the frame 1. These flaps 8 in conjunction which the U-shaped ends already described provide a seal with the pan handle on which the extinguisher is used.

The extinguisher is stored in a holder 7, which may be made of plastic or other man made material, metal or natural materials such as wood or combinations of these. In the stored position, the resilient folding arms adopt the position shown in FIGS. 5 and 6 and the handle 2 is rotated through 180° to overlie the holder 3 as shown particularly in FIG. 6. The extinguisher may be removed for use firstly by folding the handle 2 back into the position shown in FIG. 2, where it will be retained by clips or other means (not shown). The extinguisher is then withdrawn from the holder allowing the arms 3 to unfold stretching the smothering material 4 into position as shown in FIG. 1.

Using the handle the extinguisher is placed over the container of burning fat/oil and gently lowering the extinguisher on top of the pan.

The extinguisher can be durable and reusable subject to the materials used.

In other examples (not shown) as necessary the frame can be rigid or folding and made of suitable man made or natural materials or combinations of these and be constructed to any shape or size. It can be integral with the smothering material or attached to it.

The unfolding mechanism can be heat operated.

The smothering material can be impregnated with fire retardants which are released on contact with flame/heat.

The smothering material can be shaped/cut to make it suitable for any features of the deep fat container or pan.

The handle can be folding, rigid or detachable/attachable.

I claim:

1. An extinguisher for extinguishing pan fires, comprising a frame, a handle connected to the frame, resilient means connected to the frame and smothering material connected to the frame, the resilient means being movable between a stored position in which the extinguisher may be stored in a holder and an operative position in which the smothering material is automatically extended by the resilient means.

2. An extinguisher as claimed in claim 1, in which the handle and/or frame are made from metal or synthetic plastics material.

3. An extinguisher as claimed in claim 2, in which the handle and/or frame are made from wire.

4. An extinguisher as claimed in claim 2, in which the handle and/or frame are pressed out.

5. An extinguisher as claimed in claim 2, in which the handle and/or frame are stamped out.

6. An extinguisher as claimed in claim 2, in which the handle and/or frame are moulded.

7. An extinguisher as claimed in claim 1, in which the handle and/or frame are formed to provide positioning means.

8. An extinguisher as claimed in claim 1, which the resilient means comprises a spring.

9. An extinguisher as claimed in claim 8, in which the spring is helical.

10. An extinguisher as claimed in claim 1, in which the handle is pivotally connected to the frame to enable it to be folded with respect to the frame for storage to lie over the holder.

11. An extinguisher as claimed in claim 1, in which the smothering material is connected to the resilient means by means of stitching.

* * * * *